US005983883A

United States Patent [19]

Moulder

[11] Patent Number: 5,983,883

[45] Date of Patent: Nov. 16, 1999

[54] MOUNTING APPARATUS FOR PORTABLE STOVES

[76] Inventor: Charles R. Moulder, 300 E. 40th St. Apt. 10E, New York, N.Y. 10016

[21] Appl. No.: 08/763,185

[22] Filed: Dec. 10, 1996

[51] Int. Cl.[6] ..... F24C 5/20

[52] U.S. Cl. ..... 126/38; 126/40; 126/9 R; 126/50; 248/346.03; 248/689

[58] Field of Search ..... 126/38, 44, 9 R, 126/39 B, 40, 42, 52, 50, 24, 30, 36, 37 R; 269/131; 294/149, 150, 151, 157; 248/311.3, 689, 346.03

[56] References Cited

U.S. PATENT DOCUMENTS

| | | | |
|---|---|---|---|
| 3,372,688 | 3/1968 | Moore | 126/24 |
| 3,393,672 | 7/1968 | Costopoulos | 126/404 |
| 3,730,165 | 5/1973 | Williams | 126/38 X |
| 3,877,458 | 4/1975 | Allander | 126/38 X |
| 3,896,784 | 7/1975 | Baxter | 126/38 |
| 3,900,281 | 8/1975 | Penberthy | 126/44 |
| 4,005,844 | 2/1977 | Richmond | 248/311.3 |
| 4,577,418 | 3/1986 | Nagy | 36/72 B |
| 4,796,936 | 1/1989 | Sherin | 294/31.2 |
| 4,832,398 | 5/1989 | Tecca et al. | 294/151 |
| 4,954,075 | 9/1990 | Francino | 431/107 |
| 5,211,157 | 5/1993 | Schwartz et al. | 126/40 X |
| 5,307,798 | 5/1994 | Overmars, Sr. | 126/40 |
| 5,323,757 | 6/1994 | Humphrey | 126/24 |
| 5,370,527 | 12/1994 | Hefling et al. | 126/39 R |
| 5,411,011 | 5/1995 | Teta | 126/50 |
| 5,425,354 | 6/1995 | Park | 126/50 |
| 5,431,146 | 7/1995 | Humphrey | 126/24 |
| 5,782,449 | 7/1998 | Church et al. | 126/40 X |

*Primary Examiner*—Larry Jones
*Attorney, Agent, or Firm*—Juan C. Villar, Esq.

[57] ABSTRACT

The present invention relates to a portable stove mounting apparatus used to securely mount a removable portable stove to a planar supporting structure without the use of hand tools. The portable stove mounting apparatus includes a planer base supporting structure wherein connecting devices secure the portable stove and fuel supply to the planer base supporting structure. Insulation is disposed between the connecting devices and the planar supporting structure.

33 Claims, 5 Drawing Sheets

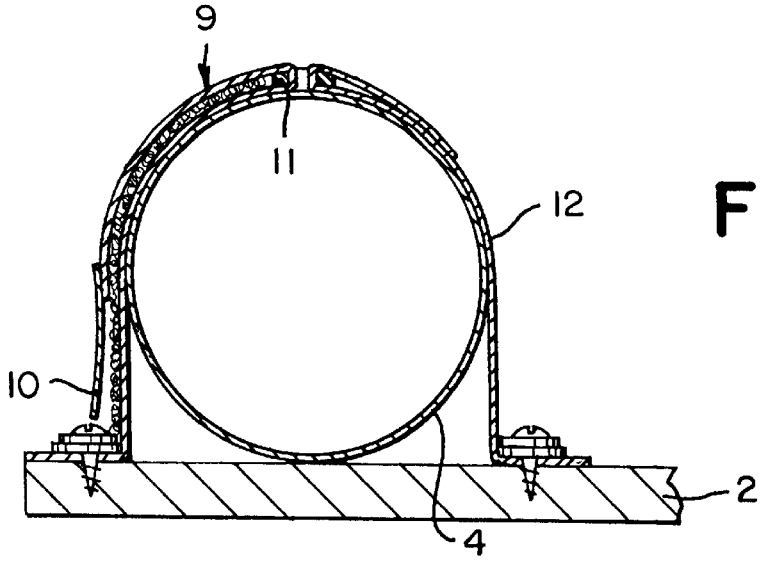
FIG. 4
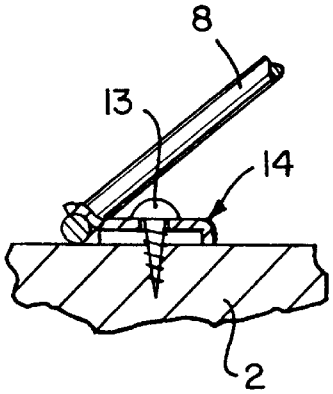
FIG. 5
FIG. 6
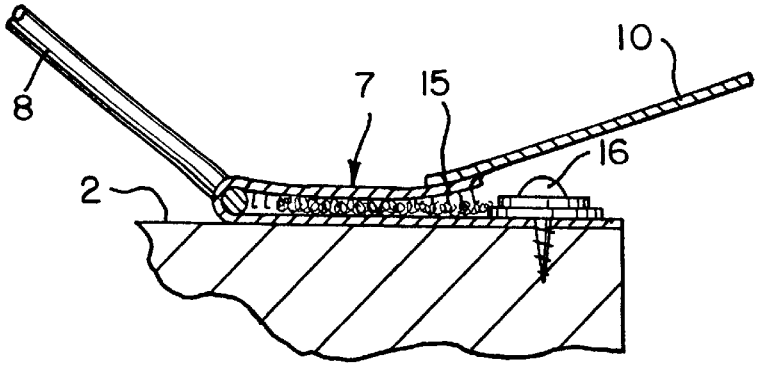

MOUNTING APPARATUS FOR PORTABLE STOVES

BACKGROUND OF THE INVENTION

1. Field of the Invention

The present invention relates to a mounting apparatus for securing a portable stove to a flat, horizontal base material. In particular, this invention relates to a mounting apparatus for safely securing outdoor portable stoves that are commonly used while camping.

2. Discussion of the Related Art

Portable stoves for camping and hiking are generally small and light weight. These stoves utilize a butane, propane or white gas for the fuel source, which is contained in a separate tank or bottle. Typically the stove is carried by the camper or hiker in a backpack.

It is generally advantageous to find a flat, level surface to place the stove on. To avoid placing the stove directly on the ground, various stove mounting devices have been previously described. For example, U.S. Pat. No. 5,323,757 describes a portable mounting apparatus for mounting a stove to a filleting board, which is subsequently secured to a fixture on a motor vehicle or boat that is immediately accessible. Thus, the person who is using this apparatus must have a vehicle or boat immediately accessible. Accordingly, this device is not useful to secure the cooking stove to an apparatus when backpacking or hiking, where the only equipment available to the campers is the equipment carried in their backpack.

To use the commercial stoves while backpacking or hiking, the camper often experiences difficulties in finding a flat, level surface sufficient to use the stove effectively and safely. Hikers, for example, often must cook on rough, uneven rocky ground. This makes cooking extremely difficult because a pot does not remain on the stove. Furthermore, it is dangerous to use the stove on uneven surfaces because it can readily fall over.

During alpine camping and hiking, when the temperature is below freezing, it is usually difficult to find an appropriate surface for the camping stove due to snow and ice on the ground. The camping stove is often placed inside the tent to provide heat as well as a cooking source. The surface inside the tent is frequently uneven, which makes cooking extremely difficult and hazardous. Campers generally must use whatever available resources they have to create a flat, level surface for cooking. Moreover, due to the dangers associated with having an open flame in a tent, the cooking stove should be able to be quickly removed from the tent. Another difficulty associated with using portable stoves during the winter is that the fuel bottle often becomes frozen to the ground when it comes into contact with the snow or ice.

Also known are wire frame supports such as in U.S. Pat. No. 5,307,798 wherein is disclosed a spider-like structure having at least three legs that support a stove. These devices present the same problems encountered with placing the stove on the ground directly—the tendency of the stove to sink into soft surfaces. The problem is particularly acute in snow or ice conditions, where the metal wire frame conducts heat from the burning stove and causes the frame structure to melt and subsequently sink into the snow or ice.

Thus, there is a need for a convenient apparatus that secures a portable camping stove to a flat, level base surface, which is lightweight and easily transportable in a backpack. There is a further need for an apparatus that securely fastens the stove to the base surface to permit the rapid removal of the connected stove in the event of an emergency.

SUMMARY OF THE INVENTION

It is an object of this invention to provide an apparatus for securely mounting a removable portable stove to a planar supporting base structure.

It is another object of this invention to provide an apparatus whereby a portable stove can be mounted to a planar supporting structure without the use of hand tools.

It is a further object of this invention to provide an apparatus for securely mounting a removable portable stove to a base board, which can be easily assembled while wearing gloves or mittens.

It is yet another object of this invention to provide an apparatus to securely fasten a portable stove and fuel tank to permit the expeditious removal of the stove and fuel tank in the event of an emergency.

It is a further object of this invention to provide an apparatus that prevents the fuel bottle from coming into contact with snow or ice.

It is another objection of this invention to overcome the deficiencies of the prior art.

The objects of the present invention are achieved in accordance with a preferred embodiment of the invention that includes a portable stove mounting apparatus which is capable of securely mounting a removable portable stove to a planar supporting structure without the use of hand tools. The portable stove mounting apparatus includes a planar base supporting structure, such as, for example, a board. Connecting devices secure the portable stove and the fuel supply to the planar base supporting structure. Insulation is disposed between the connecting devices and the planar supporting structure. In a preferred embodiment of this invention, the connecting devices include a strap with hook and loop fasteners, which are fixedly attached to the base.

BRIEF DESCRIPTION OF THE DRAWINGS

FIG. 4 is a cross-sectional view taken along lines 4—4 of FIG. 1 and looking in the direction of the arrows;

FIG. 5 is a cross-sectional view taken along lines 5—5 of FIG. 1 and looking in the direction of the arrows;

FIG. 6 is a cross-sectional view taken along lines 6—6 of FIG. 1 and looking in the direction of the arrows;

DETAILED DESCRIPTION OF THE INVENTION

Figure 1:
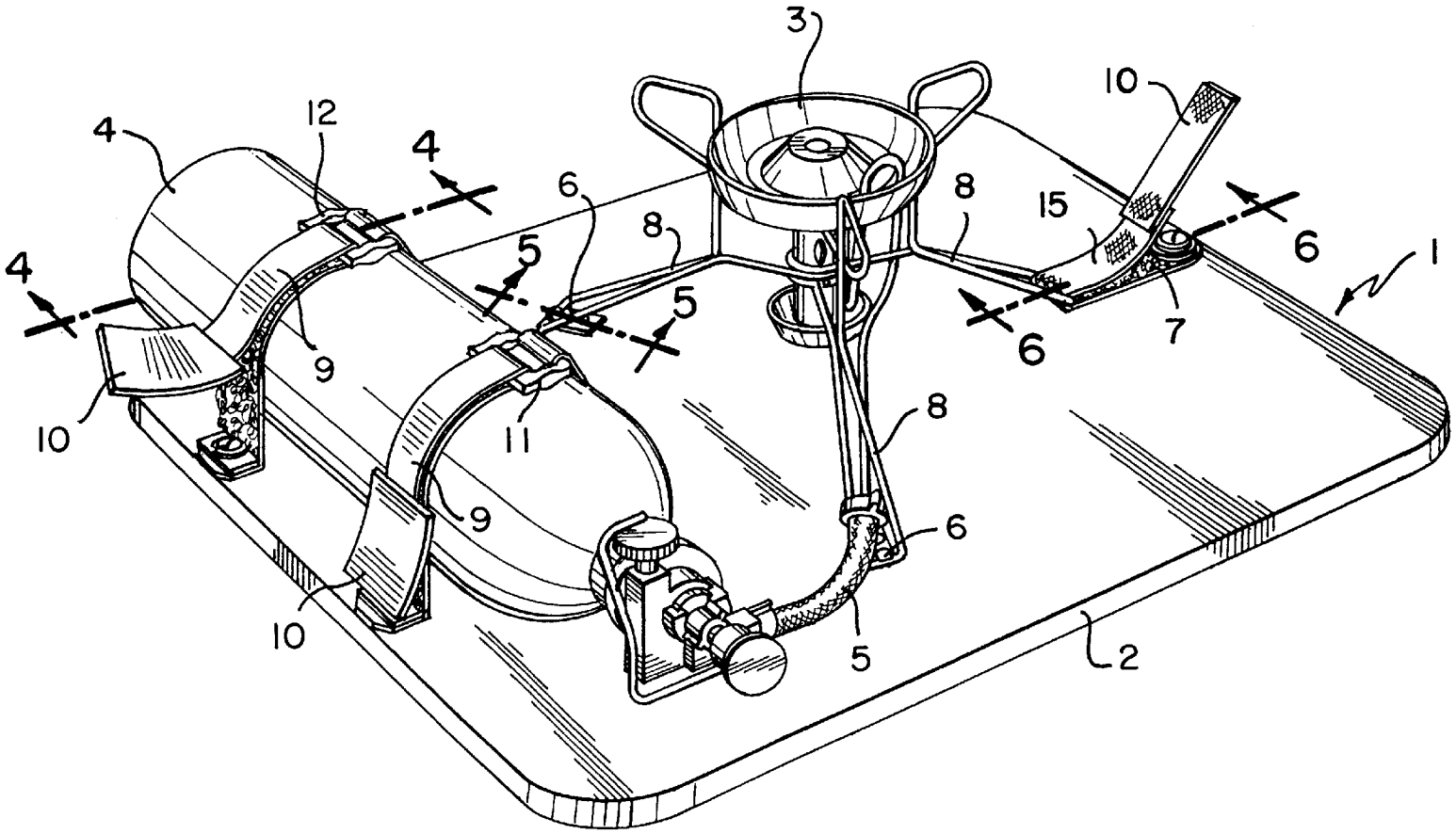
FIG. 1 is a perspective view of a preferred embodiment in accordance with the present invention.

Referring now to FIG. 1, a camping stove apparatus 1 is illustrated. The apparatus includes a flat support base member 2, a cooking element 3, a fuel tank, and a fuel conveying hose 5. The flat support base member 2 may be made of any material sufficiently capable of supporting a conventional cooking pot, such as wood, plastic or other suitable material.

The base member 2 may consist of a fire resistant material and/or may be coated with a fire resistant material. Moreover, the base member 2 may be modified to make it more light weight, for example, by adding holes throughout the base member. The fuel conveying hose 5 provides selective fluid communication between fuel tank 4 and cooking element 3.

Cooking element 3 is preferably in the form of a conventional gas or white gas stove. Three elongated legs 8 are detachably secured to base 2 by securing devices 6 and 7. Cooking element 3 is detachably connected to base 2 by legs 8. Elongated legs 8 may be formed from aluminum or other metal and, as shown in FIGS. 1 and 5, form a loop. Holding element or hook 14 is secured to base 2 via fastener 13 (see FIG. 5). Referring now to FIGS. 1 and 6, cooking element 3 is secured to base 2 via securing device 7. Securing device 7 includes a hook and loop type strap 15. Of course, strap 15 may be made from other suitable fasteners, such as, for example, snaps, magnetic closures, etc. Strap 15 has an enlarged pull-tab 10 disposed at its free end and is, at its other end, fixedly secured to based by fastener 16.

To secure cooking element 3 to support member 2, two of the three elongated legs 8 of cooking element 3 are positioned proximate to hooks 14. The third elongated leg 8 of cooking element 3 is then fastened by inserting strap 15 into and through the loop formed by the remaining elongated leg 8 and then is tightly fastened upon itself as shown in FIGS. 1 and 6.

Fuel tank 4 typically contains a liquid-type fuel, which is utilized by the cooking element 3 in operation of the invention. Fuel tank 4 is secured to support member 2 via straps 9. Straps 9 may be in the form of hook and loop type straps, each of which is associated with a loop 11 and strap 12. Loop 11 is secured to one end of strap 12, and the other end of strap 12 is fixedly secured to support member 2. As shown in FIGS. 1 and 4, to secure fuel tank 4 to base 2, strap 9 is inserted into and through loop 11 and then fastened upon itself, as is shown in FIG. 1. Relatively enlarged pull-tabs 10 are provided on a free end of strap 9 to facilitate easy gripping of straps 9, especially when the user is wearing gloves or mittens, to thereby permit the insertion and removal of fuel tank 4 from base 2.

Conduit 5 may comprise a hose, as shown in FIG. 1, or any other suitable device for conveying fuel that is contained in fuel tank 4 to the cooking element 3.

Figure 2:
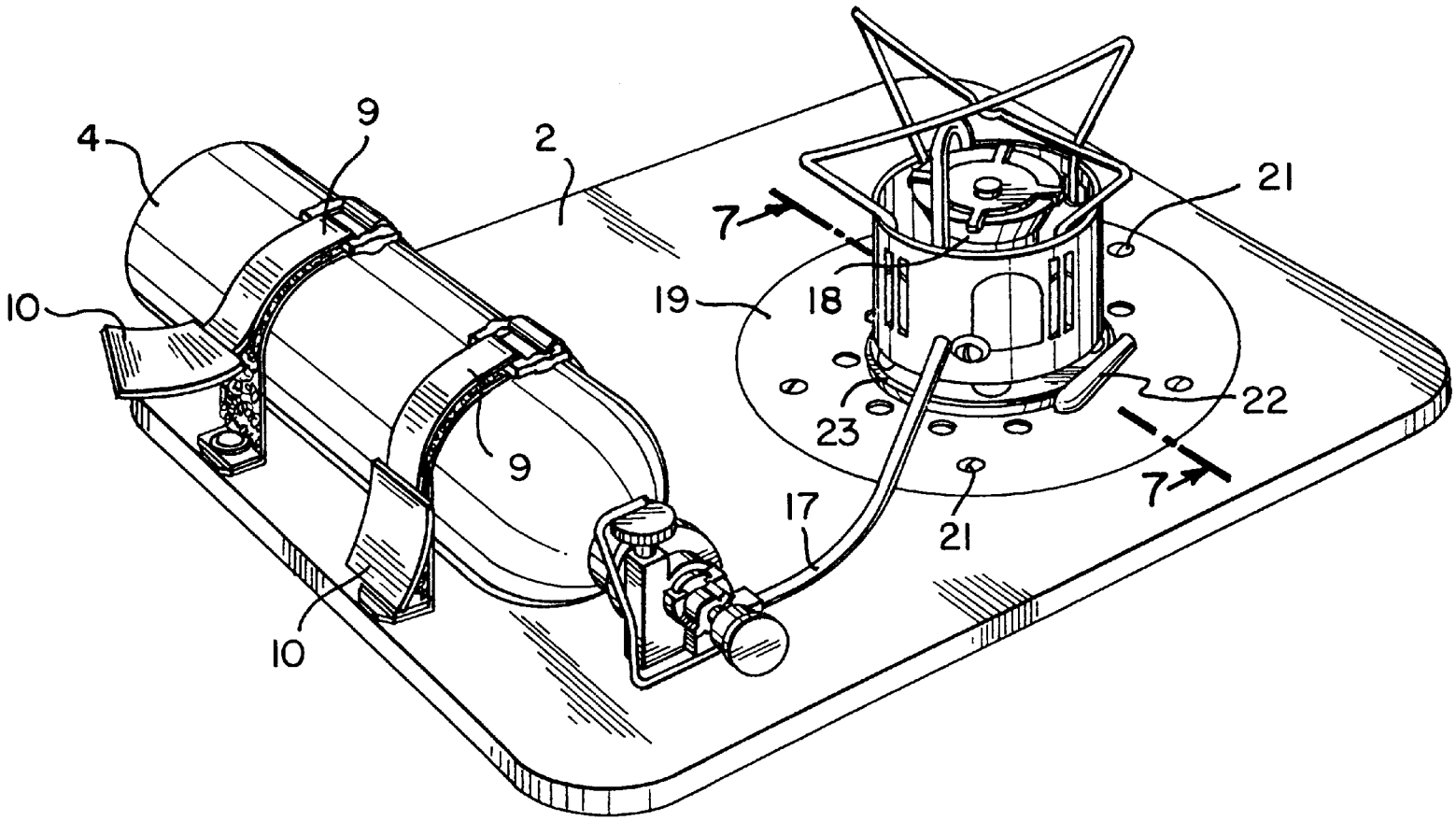
FIG. 2 is a perspective view of a further embodiment in accordance with the present invention.
Figure 7:
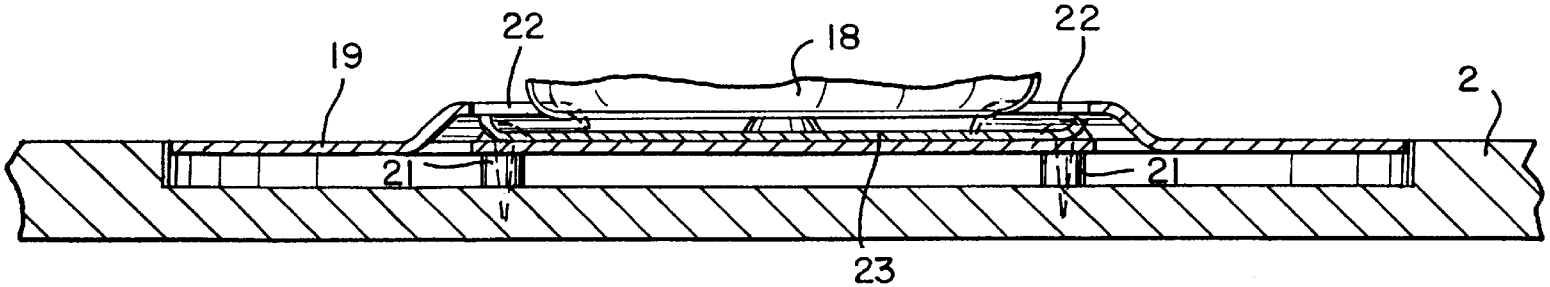
FIG. 7 is a cross-sectional view taken along lines 7—7 of FIG. 2 and looking in the direction of the arrows.

Referring now to FIG. 2, a further embodiment of the present invention is illustrated. A bottom plate 19 is secured to support member 2 via fasteners 21. Preferably, bottom plate 19 is secured to support member 2 via five equally spaced screws. However, more or less screws may be used. As depicted in FIGS. 2 and 7, when assembled, an upper surface of bottom plate 19 of cooking element 18 is flush with an upper surface of base 2. Two raised notches 22 are disposed on the upper facing surface of bottom plate 19. Notches 22 are spaced approximately 120° apart (only one raised notch 22 is shown in FIG. 2, the other being hidden from view behind cooking element 18). Cooking element 18 is detachably secured to base 2 by placing a lower flange 23 of cooking element 18 within notches 22. Conduit 17 is made of a rigid material and provides fluid communication between cooking element 18 and tank 4. When tank 4 is secured to base 2, conduit 17 prevents flanges 23 from disengaging from raised notches 22, thereby effectively securely maintaining the position of cooking element 18 with respect to base 2. In operation, fuel is conveyed from fuel tank 4 to cooking element 18 via conveying pipe 17. The stove may be used in an otherwise conventional manner yet now the stove and the fuel tank are rigidly attached to the working surface, according to the invention.

Figure 3:
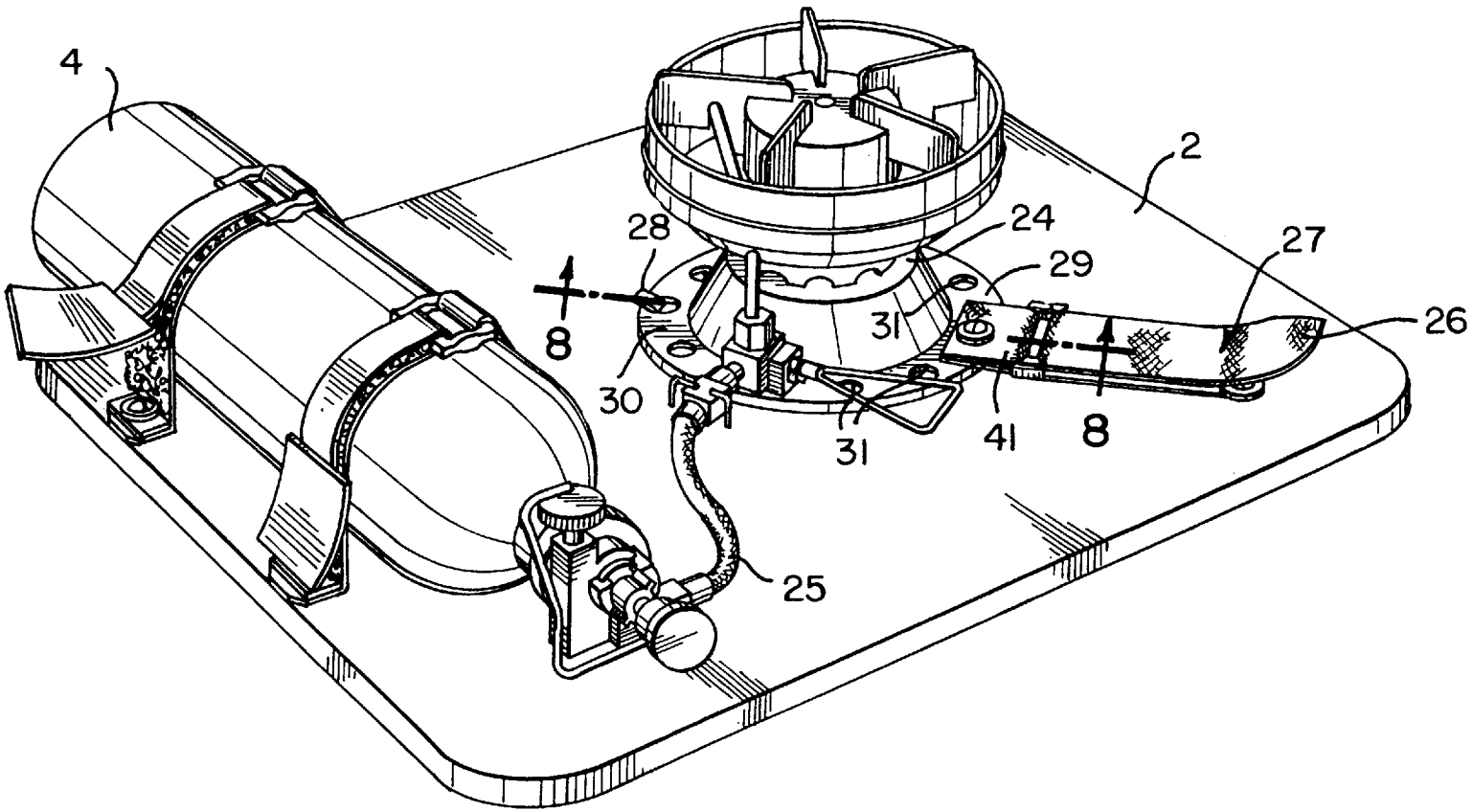
FIG. 3 is a perspective view of a further embodiment in accordance with the present invention.
Figure 8:
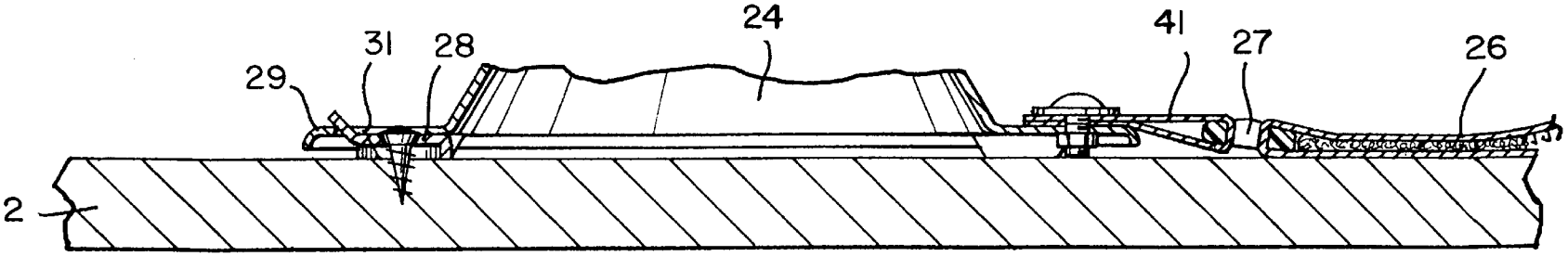
FIG. 8 is a cross-sectional view taken along lines 8—8 of FIG. 3 and looking in the direction of the arrows.

Referring now to FIGS. 3 and 8, a further embodiment of the present invention is illustrated. Cooking element 24 is secured to base 2 via lip 28 and strap 27. Strap 27 may be, for example, a hook and loop type strap. A pull tab 26 is disposed at a free end of strap 27. The other end of strap 27 is fixedly secured to base 2. A loop 41 of fabric is fixedly attached to a bottom flange 29 of cooking element 24. Strap 27 is detachably connected to loop 41, as shown in FIGS. 3 and 8. Cooking element 24 is detachably secured to base 2 via lip 28, which abuts against the inside of a hole 31 provided in flange 29. Conduit 25 may be made from any suitable material appropriate for conveying the fuel, such as aluminum or other metal, rubber, nylon or other artificial fiber.

Having described the presently preferred exemplary embodiment of a new and improved portable cooking apparatus, in accordance with the present invention, it is believed that other modification, variations and changes will be suggested to those skilled in the art in view of the teachings set forth herein. It is, therefore, to be understood that all such modifications, variations and changes are believed to fall within the scope of the present invention as defined by the appended claims.

What is claimed is:

1. A portable mounting apparatus for supporting a cooking element, comprising:

a substantially flat solid fire-resistant base;

a first securing device for detachably securing a cooking element to said base;

a second securing device spaced from said first securing device for detachably securing a fuel supply to said base; and wherein at least one of said securing devices further comprises at least one hook and loop type fastener.

2. The apparatus of claim 1 further comprising at least one pull tab for gripping and detachment of the cooking element.

3. The apparatus of claim 1 further comprising at least one pull tab for gripping and detachment of the fuel supply.

4. The apparatus of claim 1, further comprising a fuel conduit being in fluid communication with said fuel supply and said cooking element.

5. The apparatus of claim 1, wherein said base is coated with a fire resistant material.

6. The apparatus of claim 1 wherein

Said base further comprises a bottom plate to which said first securing device is attached; and said bottom plate comprises a fire-resistant material.

7. The apparatus of claim 1 wherein said solid base is made of plastic.

8. A portable mounting apparatus for supporting a cooking element, comprising:

a substantially flat solid base;

a first securing device for detachably securing a cooking element to said base;

a second securing device for detachably securing a fuel supply to said base; and wherein at least one of said securing devices furthers comprises at least one pull tab for gripping and detachment.

9. The apparatus of claim 8, wherein said first securing device further comprises at least one hook and loop type strap.

10. The apparatus of claim 8, wherein said second securing device further comprises at least one hook and loop type strap.

11. The apparatus of claim 8, wherein said second securing device further comprises at least one strap.

12. The apparatus of claim 8 wherein

Said base further comprises a bottom plate to which said first securing device is attached; and said bottom plate comprises a fire-resistant material.

13. The apparatus of claim 8 wherein said solid base is made of plastic.

14. A portable mounting apparatus for supporting a cooking element, comprising:

a substantially flat solid base;

a first securing device for detachably securing a cooking element to said base;

wherein said flat solid base further comprises:

a solid area directly beneath the cooking element when attached by said first securing device; and wherein said solid area is of such dimension and position so as to substantially obstruct a flow of heat from the cooking element to a surface upon which said flat solid base rests.

15. The apparatus of claim 14 wherein said first securing device comprises two raised notches spaced approximately 120 degrees apart.

16. The apparatus of claim 14 wherein

Said base further comprises a bottom plate to which said first securing device is attached; and said bottom plate comprises a fire-resistant material.

17. The apparatus of claim 16 wherein said fire-resistant material is metal.

18. The apparatus of claim 14 wherein said solid base is made of plastic or wood.

19. The apparatus of claim 14 wherein said base is coated with a fire-resistant material.

20. The apparatus of claim 19 wherein said fire-resistant material is metal.

21. The apparatus of claim 14 wherein said first securing device includes at least one hook-and-loop-type strap.

22. The apparatus of claim 14 further comprising at least one pull tab for detachment of the cooking element.

23. The apparatus of claim 14 further comprising a second securing device for detachably securing a fuel supply to said base.

24. The apparatus of claim 23 wherein said first securing device comprises two raised notches spaced approximately 120 degrees apart.

25. The apparatus of claim 23 wherein

Said base further comprises a bottom plate to which said first securing device is attached; and said bottom plate comprises a fire-resistant material.

26. The apparatus of claim 25 wherein said fire-resistant material is metal.

27. The apparatus of claim 23 wherein said solid base is made of plastic or wood.

28. The apparatus of claim 23 wherein said base is coated with a fire-resistant material.

29. The apparatus of claim 28 wherein said fire-resistant material is metal.

30. The apparatus of claim 23 wherein said first securing device includes at least one hook-and-loop-type strap.

31. The apparatus of claim 23 further comprising at least one pull tab for detachment of the cooking element.

32. The apparatus of claim 23 wherein said second securing device includes at least one strap.

33. The apparatus of claim 23 wherein said second securing device includes at least one hook-and-loop-type strap.

* * * * *